US009593001B2

(12) United States Patent
Frizzell

(10) Patent No.: US 9,593,001 B2
(45) Date of Patent: Mar. 14, 2017

(54) MECHANISM FOR TRANSLATION/ROTATION IN X-Y DIRECTIONS

(71) Applicant: The Boeing Company, Seal Beach, CA (US)

(72) Inventor: Matthew J Frizzell, Ballwin, MO (US)

(73) Assignee: THE BOEING COMPANY, Chicago, IL (US)

( * ) Notice: Subject to any disclaimer, the term of this patent is extended or adjusted under 35 U.S.C. 154(b) by 107 days.

(21) Appl. No.: 14/146,470

(22) Filed: Jan. 2, 2014

(65) Prior Publication Data

US 2015/0063965 A1 Mar. 5, 2015

Related U.S. Application Data

(60) Provisional application No. 61/870,774, filed on Aug. 27, 2013.

(51) Int. Cl.

| | |
|---|---|
| ***B66F 7/20*** | (2006.01) |
| ***B66F 7/08*** | (2006.01) |
| ***B66F 7/06*** | (2006.01) |
| ***B66F 7/28*** | (2006.01) |
| ***B66F 9/065*** | (2006.01) |

(52) U.S. Cl.

CPC ..... *B66F 7/20* (2013.01); *B66F 7/0683* (2013.01); *B66F 7/08* (2013.01); *B66F 7/28* (2013.01); *B66F 9/065* (2013.01)

(58) Field of Classification Search

CPC ..... B64F 5/003; B64F 5/0036; B66F 7/28; B66F 7/20; B66F 7/0683; B66F 7/08; B66F 9/065; B62D 65/18; B61J 1/04

USPC ..... 29/35.5; 248/415, 416, 554; 414/590

See application file for complete search history.

(56) References Cited

U.S. PATENT DOCUMENTS

| | | | | |
|---|---|---|---|---|
| 2,931,519 | A * | 4/1960 | Beach | 414/589 |
| 4,906,113 | A * | 3/1990 | Sague | E02F 9/12 384/507 |
| 5,460,474 | A * | 10/1995 | Iles | 414/590 |
| 6,390,762 | B1 | 5/2002 | Peery et al. | |
| 6,485,247 | B1 | 11/2002 | Groves et al. | |
| 7,210,654 | B1 * | 5/2007 | Cox | B64C 39/024 244/190 |

(Continued)

FOREIGN PATENT DOCUMENTS

| | | |
|---|---|---|
| EP | 2165932 A2 | 3/2010 |
| ES | 2072806 A2 | 7/1995 |
| WO | 2011/061306 A1 | 5/2011 |

OTHER PUBLICATIONS

European Patent Office; European Search Report; Apr. 9, 2015; EP Application No. 14 18 0369.

*Primary Examiner* — Gerald McClain
*Assistant Examiner* — Ronald Jarrett
(74) *Attorney, Agent, or Firm* — Parsons Behle & Latimer

(57) ABSTRACT

A mechanism is disclosed for controlling the position of a heavy object, such as a part of a vehicle, in an x, y, z coordinate plane. The mechanism includes linear positioners, such as rail-guided carriage assemblies spanning the width of the mechanism, as well as longitudinal rails and blocks running the length of the mechanism. A lift table is mounted to the linear positioners such that the mechanism can be used to move the heavy object to virtually any desired position and orientation in the x, y, z coordinate plane.

24 Claims, 10 Drawing Sheets

(56) References Cited

U.S. PATENT DOCUMENTS

| | | | | |
|---|---|---|---|---|
| 8,518,839 | B2 * | 8/2013 | Gastel | B29C 70/228 384/604 |
| 2007/0009345 | A1 * | 1/2007 | Hall et al. | 414/222.01 |
| 2011/0138893 | A1 * | 6/2011 | Shiraishi | F03D 11/00 73/66 |
| 2011/0272200 | A1 * | 11/2011 | Clapp | A61G 1/017 180/54.1 |
| 2014/0261050 | A1 * | 9/2014 | Knapp | B61J 1/04 104/47 |
| 2015/0176626 | A1 * | 6/2015 | Titsch | B66C 23/62 411/257 |

* cited by examiner

MECHANISM FOR TRANSLATION/ROTATION IN X-Y DIRECTIONS

FEDERALLY SPONSORED RESEARCH OR DEVELOPMENT

This invention was made with Government support awarded by The Department of Defense. The government has certain rights in this invention.

FIELD OF THE DISCLOSURE

The present application relates generally to systems for lifting and positioning relatively large and heavy structures.

BACKGROUND

In various manufacturing settings, a need arises to position large and/or heavy components, assemblies or other payloads in a desired location in an x, y, z coordinate plane for installation or assembly. In such situations, it is often desirable to control the position of the heavy components or other parts as precisely as possible. Various carts, trolleys, jacks, and other mechanisms have been designed over the years to address this need.

Nevertheless, many existing solutions have only minimal adjustment capability, and often have no fine control. In addition, many existing solutions can accommodate only a limited number of payloads, or they are customized for one particular component, such as an aircraft engine. Thus, many existing solutions lack the versatility to handle a large range of payloads, or provide the fine control required in many manufacturing settings.

SUMMARY

The present application discloses a mechanism that can accommodate a wide variety of heavy objects and can manipulate the objects in virtually any position and desired orientation in an x, y, z coordinate plane, with both extensive adjustment capability as well as fine control.

In one example, an apparatus comprises two linear positioners, each positioner having a mounting surface and a movable table surface. The apparatus further comprises a base surface coupled to the mounting surface of the two linear positioners, two mounting plates, each plate rotationally coupled to a movable table surface, and a longitudinal rail assembly with two ends, each end slideably coupled to a mounting plate. The apparatus further comprises a top plate slideably coupled to the rail assembly. The top plate is configured to receive an object to be positioned whereby the position of the object is controlled by the relative position of the two linear positioner tables to each other, the position of the base surface, and the position of the top plate with respect to the rail assembly with minimal movement of the base surface.

The base surface may comprise a lift table enabling a user to control the height of the object.

In another example, a mechanism comprises a lift table assembly and two carriage assemblies coupled to the lift table assembly, each carriage assembly comprising a carriage configured to translate linearly in a y axis. The mechanism further comprises two slewing rings, one coupled to each carriage assembly, each slewing ring being configured to rotate radially around a z axis, and an interface plate coupled to two longitudinal rails located above the slewing rings and configured to translate linearly along the longitudinal rails in an x axis. The interface plate is configured to receive a payload to be positioned, whereby the position of the payload is controlled by the position of the lift table assembly, the relative position of the two carriage assemblies with respect to each other, and the relative position of the interface plate with respect to the longitudinal rails.

The mechanism may comprise a base mounted on a plurality of casters, a push handle coupled to the base and configured to enable a user to move the mechanism to a desired location in the x and y axes, a foot brake configured to selectively engage the casters, and a lift platform coupled to the base via a scissor lift configured to raise or lower the lift platform to a desired height in the z axis. The scissor lift may comprise a hydraulic cylinder in fluid communication with a pump handle. The mechanism may further comprise two carriage plates coupled to the lift table assembly, wherein each carriage assembly is mounted to a corresponding carriage plate. Each carriage assembly may comprise an input handle coupled to an elongated screw located between two carriage guide rails, and a guided screw carriage coupled to the elongated screw via a nut. The nut may comprise a spring-loaded, anti-backlash nut configured to substantially reduce slop between the elongated screw and the nut.

The mechanism may further comprise two adaptor plates, each adaptor plate being mounted to a corresponding carriage assembly, wherein each slewing ring is mounted to a corresponding adaptor plate. Each slewing ring may rest on a plurality of bearings. The mechanism may further comprise a pair of adjustable shim plates located on the slewing rings and configured to provide a substantially level plane between the top surfaces of the shim plates. Each shim plate may comprise a stack of narrow layers of material configured to peel away from each other to enable a user to adjust the thickness of each shim plate. Each longitudinal rail may be coupled to a plurality of rail blocks, each rail block being mounted to a corresponding rail block plate, and each rail block plate being mounted to a corresponding slewing ring. The mechanism may further comprise a screw assembly coupled to the interface plate via a plurality of interface plate fittings. The screw assembly may comprise an input handle coupled to an elongated threaded shaft, which is threadably engaged with a rail block plate fitting mounted to a rail block plate. The interface plate may comprise a plurality of threaded inserts. The mechanism may further comprise an adaptor assembly coupled to the interface plate, wherein the adaptor assembly is configured to receive and secure the payload. The payload may comprise a component of an aircraft.

In another example, a method is disclosed for maneuvering a payload in a coordinate plane having an x, y, and z axis. The method comprises moving a lift table assembly to a desired position in the x and y axes, and translating two guided screw carriage assemblies laterally in the y axis along carriage guide rails, wherein each guided screw carriage assembly is coupled to a corresponding slewing ring configured to rotate radially around the z axis, whereby the position of the payload is controlled by the relative position of the two carriage assemblies with respect to each other. The method further comprises translating an interface plate laterally in the x axis along two longitudinal rails located above the slewing rings, whereby the position of the payload is controlled by the relative position of the interface plate with respect to the longitudinal rails, and actuating a scissor lift to raise or lower a lift platform to a desired height in the z axis.

Translating the two guided screw carriage assemblies and translating the interface plate may comprise rotating input handles of corresponding elongated screws. The method may further comprise engaging a foot brake to lock a plurality of casters of the lift table assembly. Actuating the scissor lift may comprise operating a pump handle in fluid communication with a hydraulic cylinder.

BRIEF DESCRIPTION OF THE DRAWINGS

Like reference numbers and designations in the various drawings indicate like elements.

DETAILED DESCRIPTION

Figure 1A:
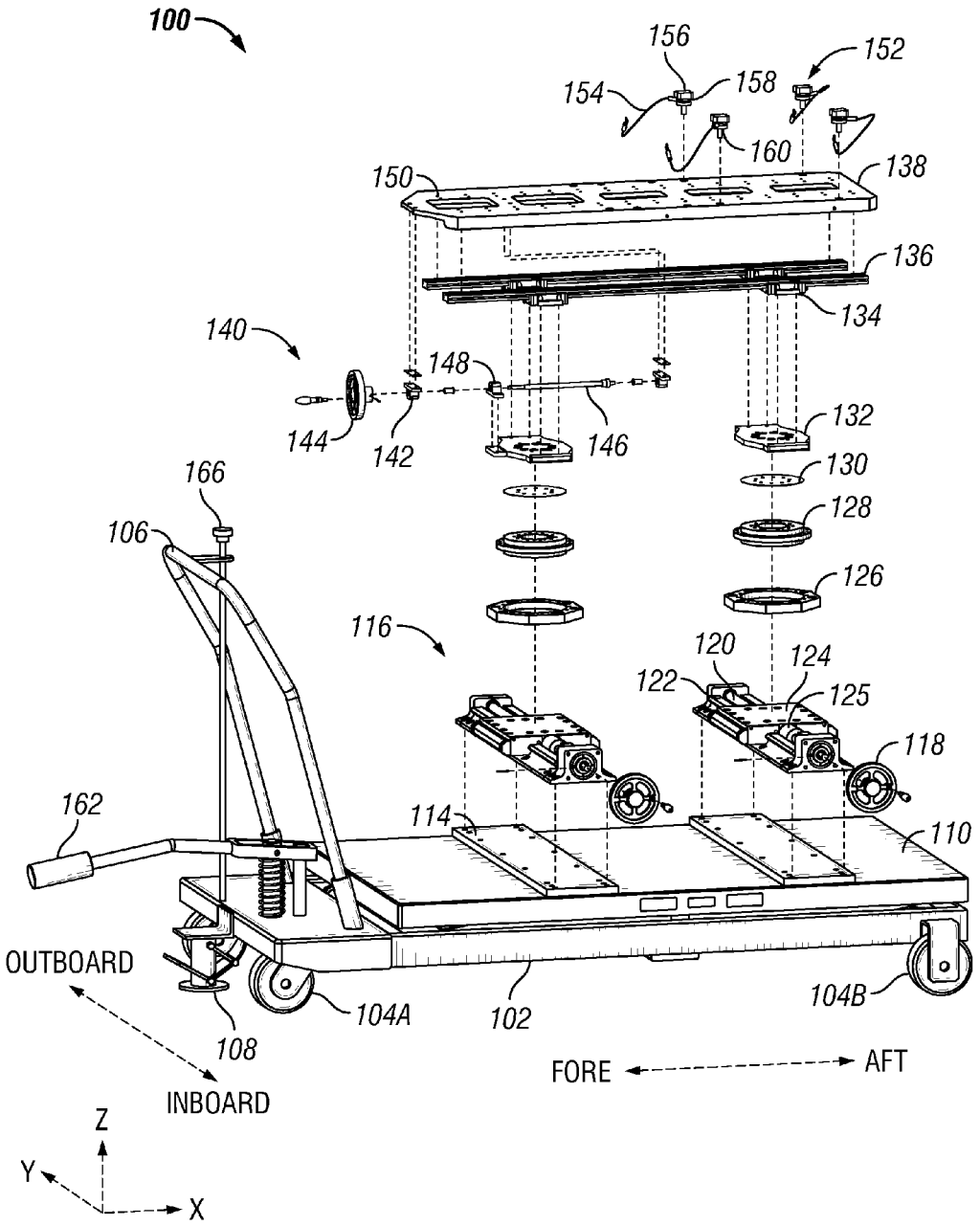
FIGS. 1A and 1B illustrate one example of an article positioning mechanism.
Figure 1B:
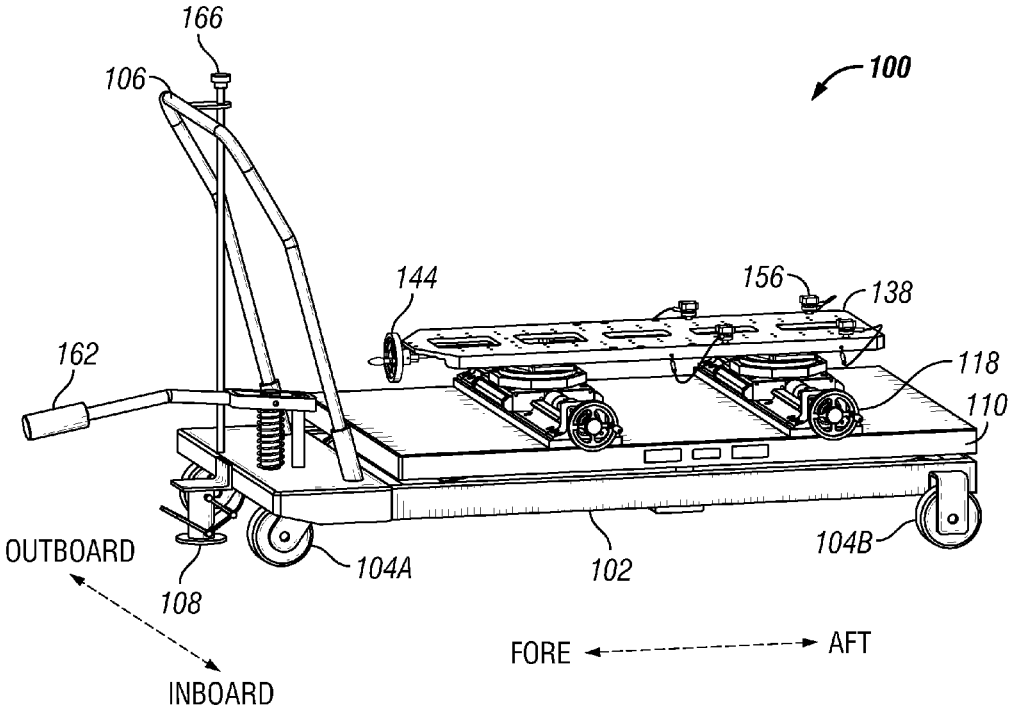

FIGS. 1A and 1B illustrate an exploded view and a perspective view, respectively, of one example of a mechanism 100 configured to move an article to a desired position in an x, y, and z axis. In the illustrated example, the mechanism 100 is configured to move and position a part of an aircraft having fore and aft sections, as well as inboard and outboard sections. Thus, the mechanism 100 has corresponding fore and aft directions in the x axis, as well as inboard and outboard directions in the y axis, as shown in FIGS. 1A and 1B.

In the illustrated example, the mechanism 100 comprises a base 102 mounted on a plurality of casters 104, including a pair of swiveling casters 104A located near the fore end and a pair of fixed casters 104B located near the aft end. The base 102 is also coupled to a push handle 106 configured to enable a user to move the mechanism 100 to a desired x-y location, as well as a foot brake 108 configured to engage the casters 104 once the mechanism reaches the desired x-y location. The mechanism 100 further comprises a lift platform 110 coupled to the base 102 via a scissor lift 112 (FIGS. 6A and 6B) configured to raise the lift platform 110 to a desired height in the z axis.

In some cases, the base 102, casters 104, push handle 106, foot brake 108, lift platform 110, and scissor lift 112 are referred to collectively as a lift table assembly, which may comprise a commercial off-the-shelf (COTS) assembly. Those of ordinary skill in the art will understand that the mechanism 100 may comprise a wide variety of suitable lift table assemblies, which may include various additional or alternative components to those shown in the illustrated example.

The mechanism 100 further comprises a pair of carriage plates 114 coupled to the lift platform 110 of the selected lift table assembly. The carriage plates 114 are configured to support and retain a pair of carriage assemblies 116. As shown in FIGS. 1A and 1B, the carriage plates 114 and carriage assemblies 116 are positioned substantially parallel to each other in the y axis, spanning the width of the base 102.

Each carriage assembly 116 comprises an input handle 118 coupled to an elongated screw 120 located between two carriage guide rails 122. A guided screw carriage 124 is coupled to the elongated screw 120 via a suitable nut 125. In some cases, the nut 125 comprises a spring-loaded, anti-backlash nut configured to substantially reduce or eliminate slop between the elongated screw 120 and the nut 125. The guided screw carriage 124 is configured to slide along the carriage guide rails 122, enabling the guided screw carriage 124 to translate in the y axis as the input handle 118 is rotated. In some cases, the elongated screw 120 has a diameter of about ⅜ inch and a pitch within the range of about 5 to about 10 revolutions/inch.

The mechanism 100 further comprises an adaptor plate 126 mounted to each guided screw carriage 124 with a plurality of suitable fasteners, such as screws, bolts, rivets, etc. In addition, the mechanism 100 comprises a pair of slewing rings 128, one mounted to each adaptor plate 126 with a plurality of suitable fasteners. The slewing rings 128 are configured to rotate radially around the z axis on a plurality of suitable bearings. The mechanism 100 also comprises a pair of adjustable shim plates 130 configured to provide a substantially level plane between the top surfaces of the shim plates 130. In some cases, each shim plate 130 comprises a stack of narrow layers of material (e.g., 0.002 inch thick), configured to peel away from each other to enable a user to adjust the thickness of each shim plate 130 until their top surfaces are in substantially the same plane.

The mechanism 100 also comprises a pair of rail block plates 132 mounted to the slewing rings 128 through the shim plates 130 with a plurality of suitable fasteners. A pair of rail blocks 134 are, in turn, mounted to each rail block plate 132. The mechanism 100 further comprises a pair of rails 136, each mounted to a pair of corresponding rail blocks 134. As shown in FIGS. 1A and 1B, the inboard rail 136 is mounted to the fore and aft inboard rail blocks 134, and the outboard rail 136 is mounted to the fore and aft outboard rail blocks 134.

The mechanism 100 further comprises an interface plate 138 mounted to the rails 136 with a plurality of suitable fasteners. The interface plate 138 is also coupled to a screw assembly 140 via a plurality of interface plate fittings 142. The screw assembly 140 comprises an input handle 144 coupled to an elongated threaded shaft 146, which is threadably engaged with a rail block plate fitting 148 mounted to the fore rail block plate 132. Thus, when the input handle 144 is rotated, the threaded shaft 146 moves within the rail block plate fitting 148, causing the interface plate 138 to move laterally in the x axis until it reaches a desired position.

The interface plate 138 comprises a plurality of threaded inserts 150 configured to receive and secure a variety of parts, components, or other structures to the interface plate 138. This configuration advantageously enables the mechanism 100 to be designed and manufactured with a universal design that can accommodate a wide variety of heavy or bulky objects. In the example shown in FIGS. 1A and 1B, the mechanism 100 comprises four hand knob assemblies 152, each one tethered to the interface plate 138 with a suitable lanyard 154. Each lanyard 154 is secured to the interface plate 138 on one end, and secured to a knob 156 on the other end with a hub 158 held in place by a retaining ring 160. The hand knob assemblies 152 can be used to secure objects to the interface plate 138, such as, for example, an adaptor assembly 270, as shown in FIGS. 2-3.

Figure 2:
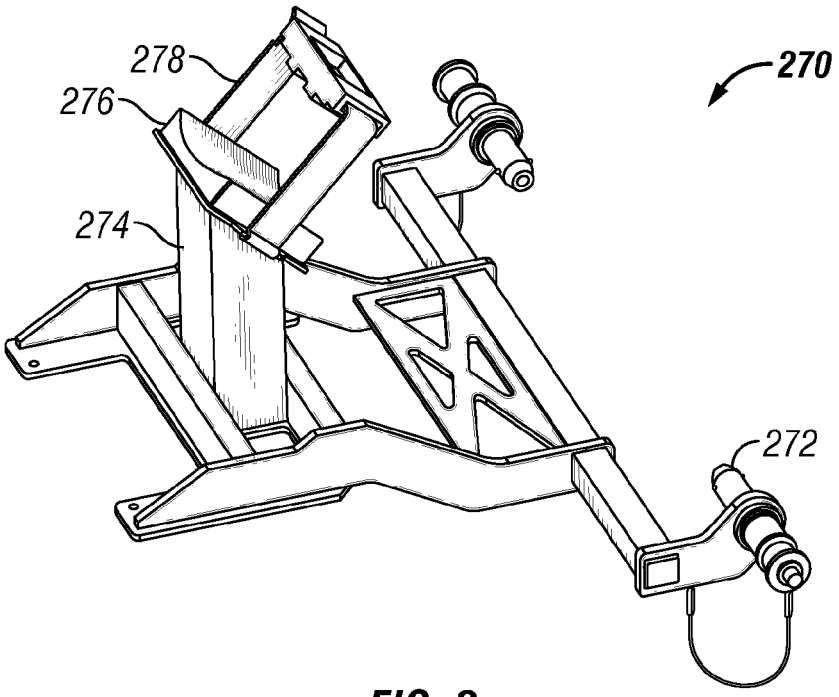
FIG. 2 illustrates one example of an adaptor assembly.
Figure 3:
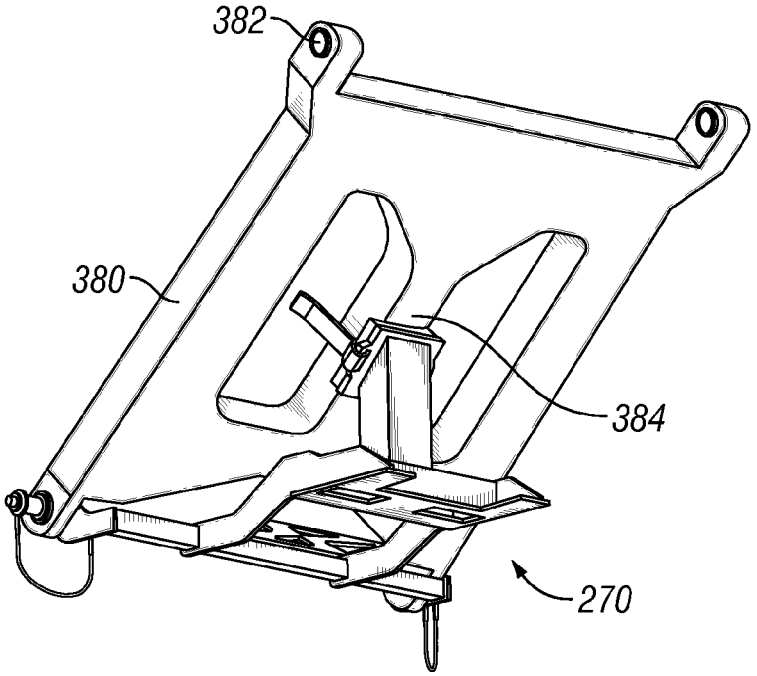
FIG. 3 illustrates one example of a part temporarily fastened to the adaptor assembly shown in FIG. 2.

FIG. 2 illustrates one example of an adaptor assembly 270, and FIG. 3 illustrates one example of a part 380 secured to the adaptor assembly 270. In the illustrated example, the adaptor assembly 270 comprises a pair of ball lock pins 272 configured to secure a lower portion of the part 380 to the adaptor assembly 270. In addition, the adaptor assembly 270 comprises a post 274 with a silicon pad 276 and a Velcro® strap 278 coupled to the top, which is configured to support and secure a mid-section of the part 380. In the example shown in FIG. 3, the part 380 comprises four lugs 382, one on each corner, which are configured to secure the part 380 in place in a vehicle, such as an aircraft, or any other suitable structure. The part 380 also comprises a central beam 384 spanning a mid-section of the part 380, which is an element of its design.

As shown in FIG. 3, the part 380 is temporarily secured to the adaptor assembly 270 by inserting the two ball lock pins 272 through the two lower lugs 382 and wrapping the Velcro® strap 278 around the central beam 384. Thus, in the particular example shown, the adaptor assembly 270 is customized for the part 380, and it is specifically designed to support and secure the part 380 in an optimal orientation for placement and installation in a vehicle or another suitable structure. Those of ordinary skill in the art will appreciate that numerous other adaptor assemblies 270 can be designed and manufactured to accommodate a wide variety of other heavy or bulky objects.

FIGS. 4-6 illustrate the mechanism 100 in operation while it is used to maneuver and position the part 380. In the illustrated example, the part 380 comprises a component of an aircraft having a fuselage 490 with an opening 492 through which the part 380 must pass to be installed in the aircraft.

Figure 4A:
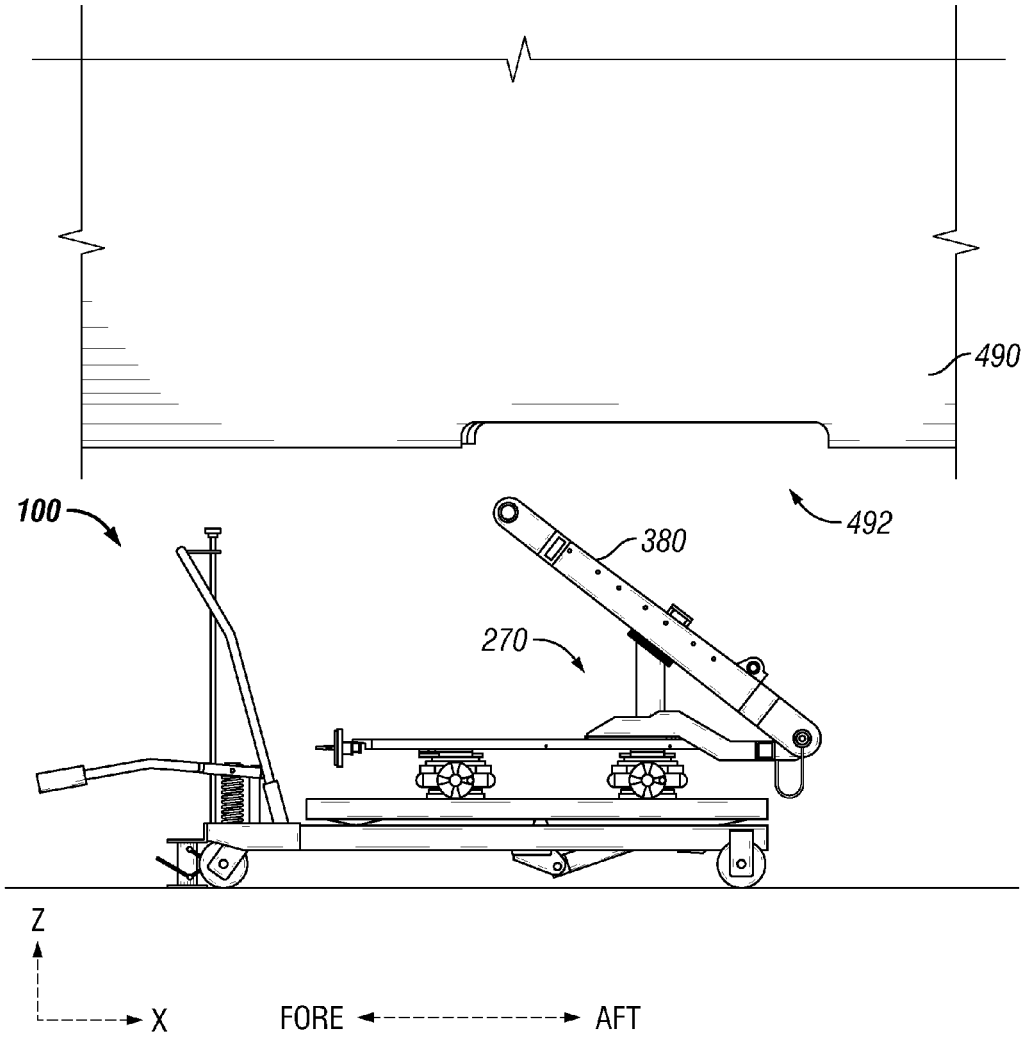
FIGS. 4A and 4B illustrate a side view and top view, respectively, of a mechanism supporting a part in a first position in an x, y, z coordinate plane.
Figure 4B:
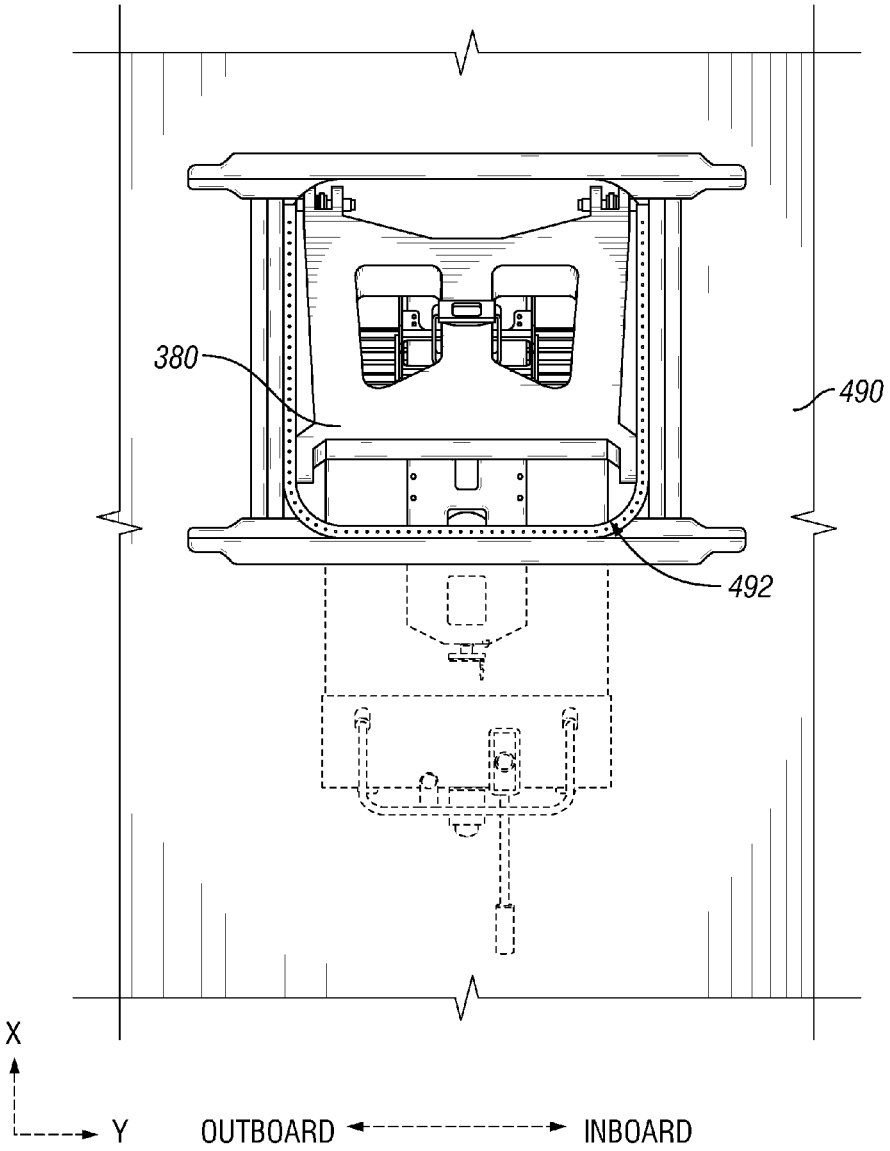

FIG. 4A illustrates a side view of the mechanism 100 with the adaptor assembly 270 and the part 380 attached, and with the part 380 located in a first position in the x, y, and z axes. FIG. 4B illustrates a top view of the mechanism 100 through the opening 492 in the fuselage 490, with the part located in the same first position shown in FIG. 4A. To maneuver the part 380 to the first position, an operator can move the mechanism 100 with the push handle 106 to the desired position in the x and y axes, and then engage the foot brake 108 to lock the casters 104 and keep the mechanism 100 fixed in place. In the particular example shown, the desired x-y position is located below the opening 492 in the fuselage 490.

Figure 5A:
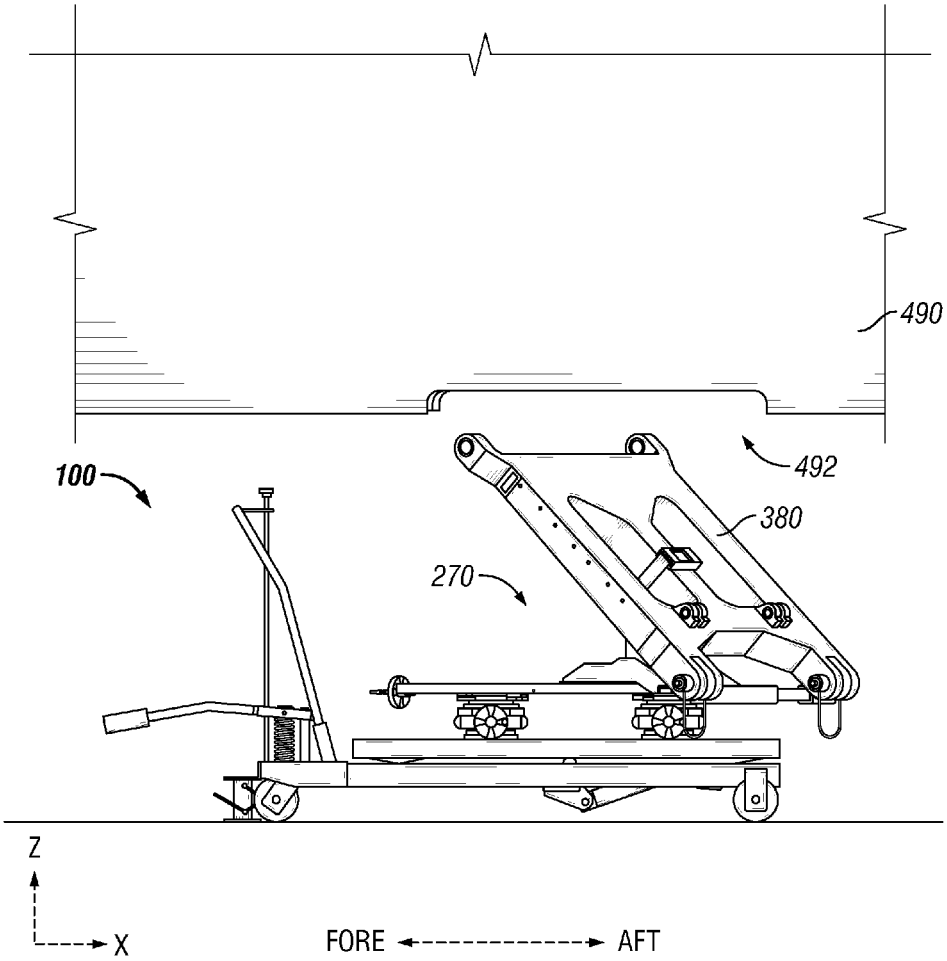
FIGS. 5A and 5B illustrate a side view and top view, respectively, of the mechanism supporting the part shown in FIGS. 4A and 4B, after it has been rotated to a second position in the x, y, z coordinate plane.
Figure 5B:
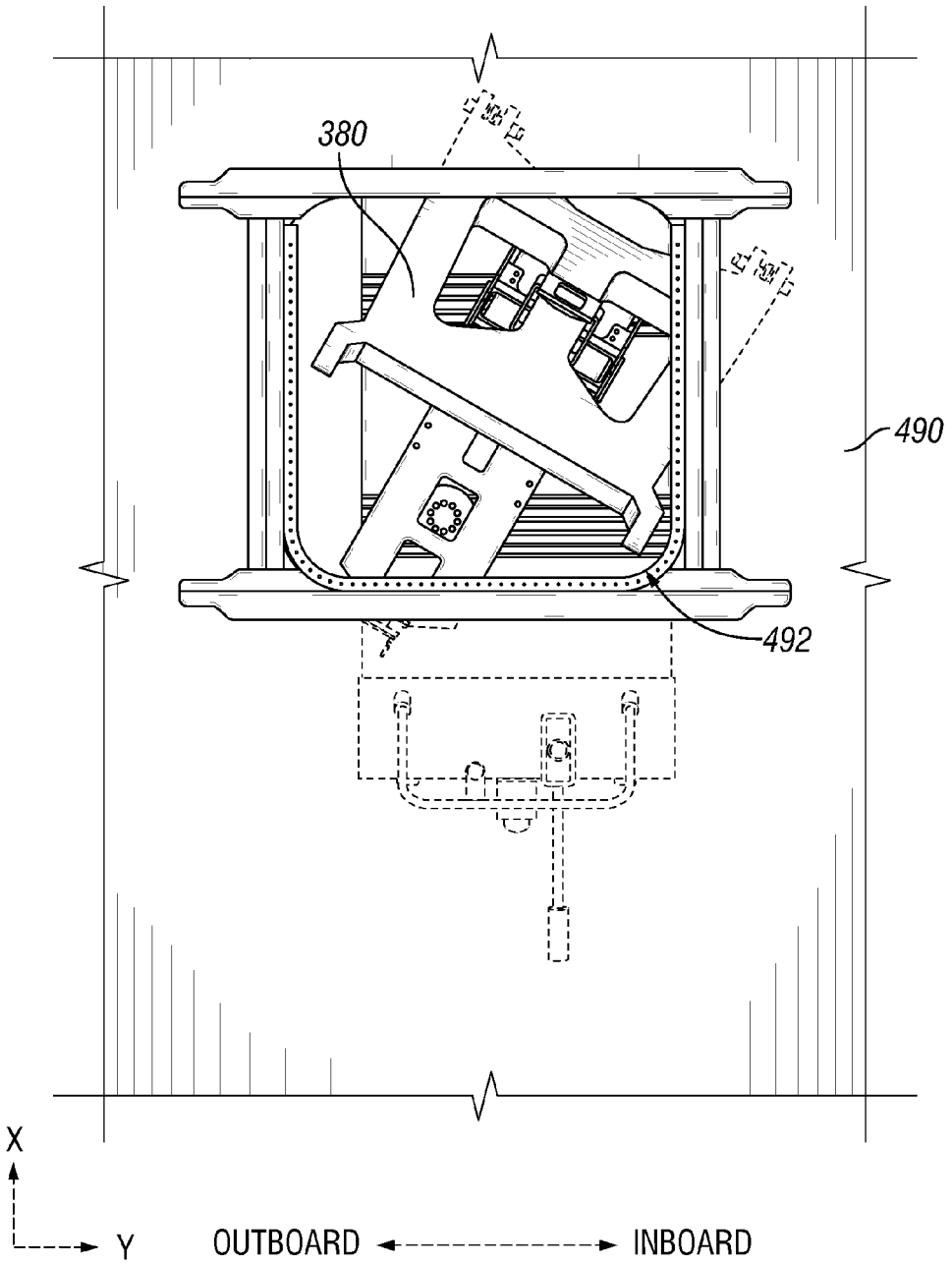

As shown in FIG. 4B, the part 380 is wider than the opening 492 when it is oriented in the first position. As a result, the part 380 cannot be lifted through the opening 492 in this orientation. Rather, the part 380 must be rotated in the x and y axes to fit through the opening 492, as shown in FIGS. 5A and 5B. Specifically, FIG. 5A illustrates a side view of the mechanism 100 once the part 380 has been rotated to a second position in the x and y axes, and FIG. 5B illustrates a top view of the mechanism 100 through the opening 492 in the fuselage 490, with the part located in the same second position shown in FIG. 5A.

To rotate the part 380 to the second position, an operator can rotate the fore input handle 118 to cause the fore guided screw carriage 124 to slide along the fore carriage guide rails 122 in the y axis, toward the outboard side of the mechanism 100. Similarly, the operator can rotate the aft input handle 118 to cause the aft guided screw carriage 124 to slide along the aft carriage guide rails 122 in the y axis, toward the inboard side of the mechanism 100. Thus, by rotating the input handles 118, the operator can position the part 380 in virtually any desired orientation in the x and y axes.

Figure 6A:
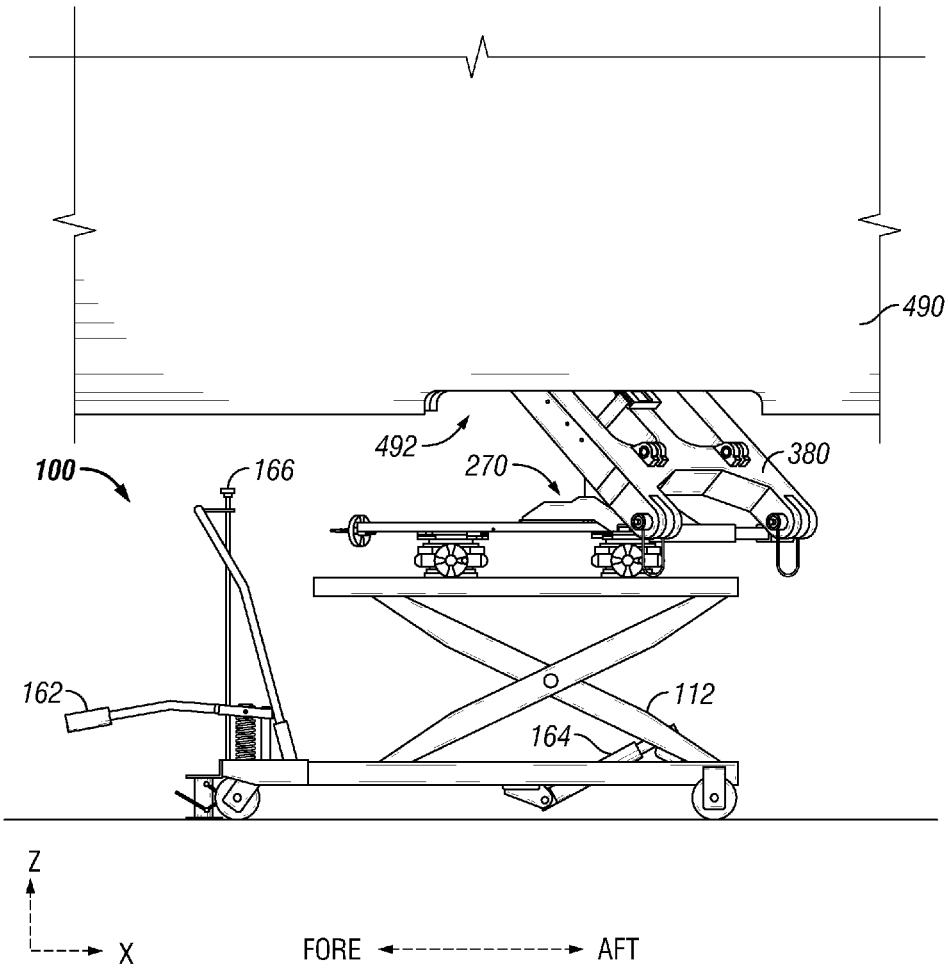
FIGS. 6A and 6B illustrate a side view and top view, respectively, of the mechanism supporting the part shown in FIGS. 5A and 5B, after it has been raised to a third position in the x, y, z coordinate plane.
Figure 6B:
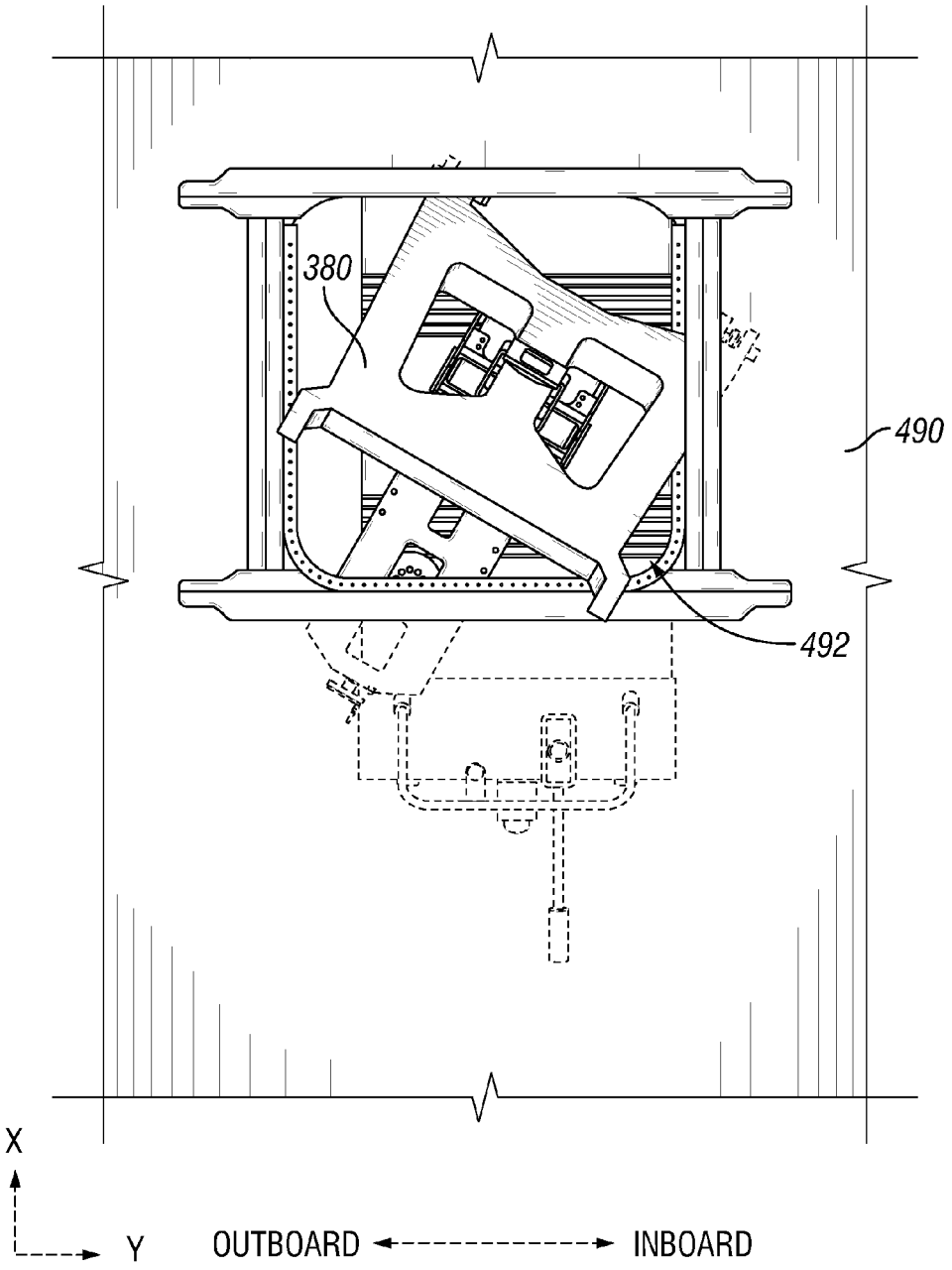

As shown in FIG. 5B, when the part 380 is rotated to the second position, it can fit through the opening 492 in the fuselage 490 diagonally. Accordingly, in this orientation, the part 380 is ready to be lifted through the opening 492, as shown in FIGS. 6A and 6B. Specifically, FIG. 6A illustrates a side view of the mechanism 100 once the part 380 has been lifted to a third position in the x, y, and z axes, and FIG. 6B illustrates a top view of the mechanism 100 through the opening 492 in the fuselage 490, with the part located in the same third position shown in FIG. 6A.

To raise the part 380 to the third position, an operator can actuate the pump handle 162 to cause the scissor lift 112 to elevate. In the illustrated example, the scissor lift 112 is actuated by a hydraulic cylinder 164 in fluid communication with the pump handle 162. Thus, when the operator actuates the pump handle 162, the hydraulic cylinder 164 causes the scissor lift 112 to rise, which causes the lift platform 110 and, hence, the adaptor assembly 270 and the part 380 to rise to the desired height in the z axis. Once the part 380 reaches the desired height, the operator can rotate the input handles 118, 144, if desired, to fine tune the position of the part 380 in the x, y, and z axes. The part 380 can then be installed in the aircraft (or other vehicle or structure).

Following the installation of the part 380, the adaptor assembly 270 can be removed from the part 380, and the scissor lift 112 can be lowered by actuating the release valve 166. In the particular example shown, actuating the release valve 166 causes hydraulic fluid to drain from the hydraulic cylinder 164 into a reservoir, which causes the scissor lift 112 to lower. Those of ordinary skill in the art will understand that numerous additional or alternative mechanisms can be used to raise and lower the lift platform 110 to a desired height in the z axis.

Figure 7:
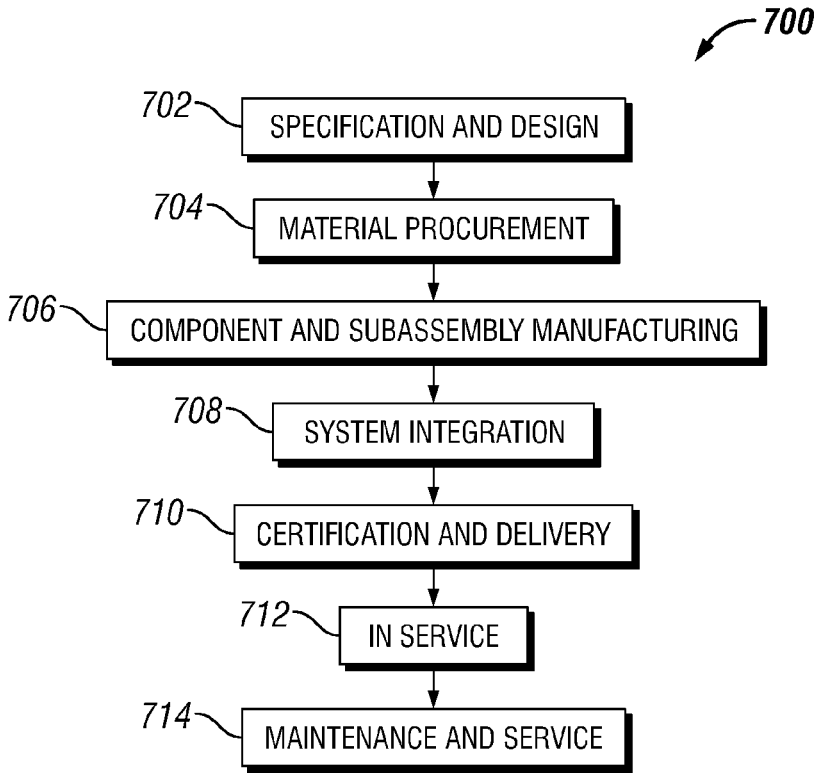
FIG. 7 illustrates a flow diagram of an aircraft production and service methodology.
Figure 8:
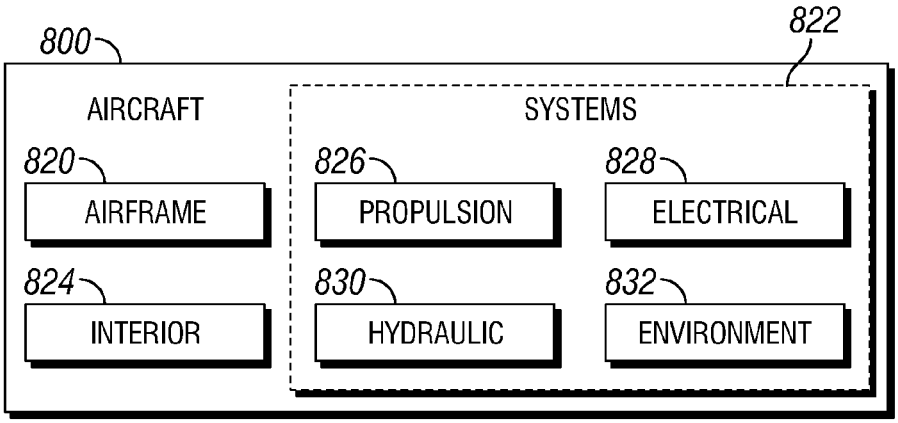
FIG. 8 illustrates a block diagram of an aircraft.

In some cases, the mechanism 100 is designed and manufactured using some commercial off-the-shelf (COTS) parts (e.g., carriage assemblies 116, rail blocks 136, rails 136, etc.) in combination with some custom designed parts (e.g., rail block plates 132, adaptor assemblies 270, etc.). The mechanism 100 comprises a combination of linear positioners that can cause linear movement of a part 380 in an x-y plane, as well as rotational movement of the part 380 around a z axis. The resulting design can be used to maneuver a part 380 to virtually any position in a given plane, subject only to the travel limits of certain components, which are a defined by, for example, the length of the screws 120, 146 and rails 122, 136, the length and width of the lift platform 110, the height of the scissor lift 112, etc. The mechanism 100 has a scalable design, so its size and configuration can be modified as needed to accommodate different payloads of varying sizes and weights. As a result, the mechanism 100 is versatile Referring to FIGS. 7-8, the systems and methods of the present application may be implemented in the context of an aircraft manufacturing and service method 700 as shown in FIG. 7 and an aircraft 800 as shown in FIG. 8. During pre-production, exemplary method 700 may include specification and design 702 of the aircraft 800 and material procurement 704. During production, component and subassembly manufacturing 706 and system integration 708 of the aircraft 800 takes place. Thereafter, the aircraft 800 may go through certification and delivery 710 in order to be placed in service 712. While in service 712 by a customer, the aircraft 800 is scheduled for routine maintenance and service 714 (which may also include modification, reconfiguration, refurbishment, and so on).

Each of the processes of method 700 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 8, the aircraft 800 produced by exemplary method 700 may include an airframe 820 with a plurality of systems 822 and an interior 824. Examples of high-level systems 822 include one or more of a propulsion system 826, an electrical system 828, a hydraulic system 826, and an environmental system 828. Any number of other systems may be included. Although an aerospace example is shown, the principles of the disclosed embodiments may be applied to other industries, such as the automotive industry.

Apparatus and methods embodied herein may be employed during any one or more of the stages of the production and service method 700. For example, components or subassemblies corresponding to production process 706 may be fabricated or manufactured in a manner similar to components or subassemblies produced while the aircraft 800 is in service 712. Also, one or more apparatus embodiments, method embodiments, or a combination thereof may be utilized during the production stages 706 and 708, for example, by substantially expediting assembly of or reducing the cost of an aircraft 800. Similarly, one or more of apparatus embodiments, method embodiments, or a combination thereof may be utilized while the aircraft 800 is in service 712, for example and without limitation, to maintenance and service 714.

Although this disclosure has been described in terms of certain preferred configurations, other configurations that are apparent to those of ordinary skill in the art, including configurations that do not provide all of the features and advantages set forth herein, are also within the scope of this disclosure. Accordingly, the scope of the present disclosure is defined only by reference to the appended claims and equivalents thereof.

What is claimed is:

1. A mechanism comprising:

a lift table assembly;

two carriage assemblies coupled to the lift table assembly, each carriage assembly comprising a carriage configured to translate linearly in a y axis;

two slewing rings, one coupled to each carriage assembly, each slewing ring being configured to rotate radially around a z axis; and an interface plate coupled to two longitudinal rails located above the slewing rings and configured to translate linearly along the longitudinal rails in an x axis independent of the two carriage assemblies, the two longitudinal rails located directly above the two carriage assemblies, wherein the interface plate is configured to receive a payload to be positioned, whereby the position of the payload is controlled by the position of the lift table assembly, the relative position of the two carriage assemblies with respect to each other, and the relative position of the interface plate with respect to the longitudinal rails.

2. The mechanism of claim 1, wherein the lift table assembly comprises:

a base mounted on a plurality of casters;

a push handle coupled to the base and configured to enable a user to move the mechanism to a desired location in the x and y axes;

a foot brake configured to selectively engage the casters; and a lift platform coupled to the base via a scissor lift configured to raise or lower the lift platform to a desired height in the z axis.

3. The mechanism of claim 2, wherein the scissor lift comprises a hydraulic cylinder in fluid communication with a pump handle.

4. The mechanism of claim 1, further comprising two carriage plates fixedly connected to the lift table assembly, wherein each carriage assembly is mounted to a corresponding carriage plate.

5. The mechanism of claim 1, wherein each carriage assembly comprises:

an input handle coupled to an elongated screw located between two carriage guide rails; and a guided screw carriage coupled to the elongated screw via a nut.

6. The mechanism of claim 5, wherein the nut comprises a spring-loaded, anti-backlash nut configured to substantially reduce slop between the elongated screw and the nut.

7. The mechanism of claim 1, further comprising two adaptor plates, each adaptor plate being mounted to a corresponding carriage assembly, wherein each slewing ring is mounted to a corresponding adaptor plate.

8. The mechanism of claim 1, wherein each slewing ring rests on a plurality of bearings.

9. The mechanism of claim 1, further comprising a pair of adjustable shim plates located on the slewing rings and configured to provide a substantially level plane between the top surfaces of the shim plates.

10. The mechanism of claim 9, wherein each shim plate comprises a stack of narrow layers of material configured to peel away from each other to enable a user to adjust the thickness of each shim plate.

11. The mechanism of claim 1, wherein each longitudinal rail is coupled to a plurality of rail blocks, each rail block being mounted to a corresponding rail block plate, and each rail block plate being mounted to a corresponding slewing ring.

12. The mechanism of claim 1, further comprising a screw assembly coupled to the interface plate via a plurality of interface plate fittings.

13. The mechanism of claim 12, wherein the screw assembly comprises an input handle coupled to an elongated threaded shaft, which is threadably engaged with a rail block plate fitting mounted to a rail block plate.

14. The mechanism of claim 1, wherein the interface plate comprises a plurality of threaded inserts.

15. The mechanism of claim 1, further comprising an adaptor assembly coupled to the interface plate, wherein the adaptor assembly is configured to receive and secure the payload.

16. The mechanism of claim 15, the adaptor assembly further comprising a pair of ball lock pins and a strap to secure the payload.

17. The mechanism of claim 1, wherein the payload comprises a component of an aircraft.

18. The mechanism of claim 1, wherein the lift table assembly comprises a lift platform coupled to a base via a scissor lift configured to raise or lower the lift platform to a desired height in the z axis and wherein the carriages of two carriage assemblies are configured to translate linearly in a single axis and span a width of the base.

19. The mechanism of claim 1, wherein each slewing ring is positioned between one of the two carriage assemblies and the two longitudinal rails.

20. The mechanism of claim 1, wherein the interface plate is directly coupled to the two longitudinal rails.

21. A method for maneuvering a payload in a coordinate plane having an x, y, and z axis, the method comprising:

moving a lift table assembly to a desired position in the x and y axes;

translating two guided screw carriage assemblies laterally in the y axis along carriage guide rails, wherein each guided screw carriage assembly is coupled to a corresponding slewing ring configured to rotate radially around the z axis, whereby the position of the payload is controlled by the relative position of the two carriage assemblies with respect to each other;

translating an interface plate laterally in the x axis independent of the two carriage assemblies along two longitudinal rails located above the slewing rings and located directly above the two guided screw carriage assemblies, whereby the position of the payload is controlled by the relative position of the interface plate with respect to the longitudinal rails; and actuating a scissor lift to raise or lower a lift platform to a desired height in the z axis.

22. The method of claim 21, wherein translating the two guided screw carriage assemblies and translating the interface plate comprises rotating input handles of corresponding elongated screws.

23. The method of claim 21, further comprising engaging a foot brake to lock a plurality of casters of the lift table assembly.

24. The method of claim 21, wherein actuating the scissor lift comprises operating a pump handle in fluid communication with a hydraulic cylinder.

* * * * *